US007086879B2

(12) United States Patent
Higham et al.

(10) Patent No.: US 7,086,879 B2
(45) Date of Patent: Aug. 8, 2006

(54) DUAL CONNECTOR ASSEMBLY WITH SLIDING KEEP-OUT MEMBER

(75) Inventors: Stephen J Higham, Houston, TX (US); Michael R. Durham, Tomball, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/975,967

(22) Filed: Oct. 27, 2004

(65) Prior Publication Data

US 2006/0089025 A1 Apr. 27, 2006

(51) Int. Cl.
*H01R 13/44* (2006.01)

(52) U.S. Cl. ..... 439/140; 439/137; 439/159

(58) Field of Classification Search ..... 439/140, 439/137, 136, 152, 159
See application file for complete search history.

(56) References Cited

U.S. PATENT DOCUMENTS 2,288,241 A * 6/1942 Holcomb ..... 439/133
2,559,151 A * 7/1951 Getzoff ..... 439/136
4,957,831 A * 9/1990 Meredith et al. ..... 429/121
5,404,090 A * 4/1995 Shinbori ..... 307/66
5,755,821 A * 5/1998 Ngai et al. ..... 439/138
5,793,352 A * 8/1998 Greenberg et al. ..... 345/699
6,764,322 B1 * 7/2004 Yu ..... 439/137

* cited by examiner

*Primary Examiner*—Gary F. Paumen
(74) *Attorney, Agent, or Firm*—Kevin M. Hart

(57) ABSTRACT

A connector assembly includes first and second sockets disposed on opposite sides of a housing and defining first and second insertion paths, respectively, for receiving a plug. A sliding keep-out member has first and second blocking surfaces. The keep-out member can move back and forth through the housing between first and second positions. In the first position, the first blocking surface blocks at least a portion of the first insertion path, but the second blocking surface clears the second insertion path. In the second position, the second blocking surface blocks at least a portion of the second insertion path, but the first blocking surface clears the first insertion path. Thus the connector assembly may receive plugs in either the first or the second socket, but not in both sockets simultaneously.

11 Claims, 3 Drawing Sheets

DUAL CONNECTOR ASSEMBLY WITH SLIDING KEEP-OUT MEMBER

FIELD OF THE INVENTION

This invention relates generally to electronic hardware. More specifically, the invention relates to connector assemblies.

BACKGROUND

Many electronic devices must be equipped with numerous ports for connecting with a variety of external and internal devices. For example, present-day computers must be equipped with numerous USB ports. Some of the ports must be accessible from outside the computer's enclosure for connection with external USB devices, while others must be accessible from inside the computer's enclosure for connection with internal USB devices. This requirement for plural ports, and for internally and externally accessible ports, increases the cost of electronic devices and consumes space inside the enclosure of the host device.

SUMMARY OF THE INVENTION

In one aspect, the invention includes a space-saving and cost-saving connector assembly. The connector assembly includes first and second sockets oriented at substantially 180 degrees from one another on opposite sides of a housing. The first and second sockets define first and second insertion paths, respectively, for receiving plugs. The connector assembly also includes a sliding keep-out member having first and second blocking surfaces. The keep-out member can be moved back and forth through the housing between first and second positions. In the first position, the first blocking surface blocks at least a portion of the first insertion path, but the second blocking surface clears the second insertion path. In the second position, the second blocking surface blocks at least a portion of the second insertion path, but the first blocking surface clears the first insertion path. Thus the connector assembly may receive plugs in either the first or the second socket, but not in both simultaneously.

In another aspect, the connector assembly may be mounted in an electronic device having an enclosure such that the first socket is accessible from outside the enclosure and the second socket is accessible from inside the enclosure.

DETAILED DESCRIPTION OF THE PREFERRED EMBODIMENTS

The drawings depict a universal serial bus ("USB") connector assembly in a computer according to a preferred embodiment of the invention. The USB connector assembly and its context are shown by way of illustration and example only. Persons having ordinary skill in the art and having reference to this description and to the drawings will readily appreciate that equivalent embodiments of the invention may be constructed for connectors other than USB connectors, and for electronic devices other than computers.

Figure 1:
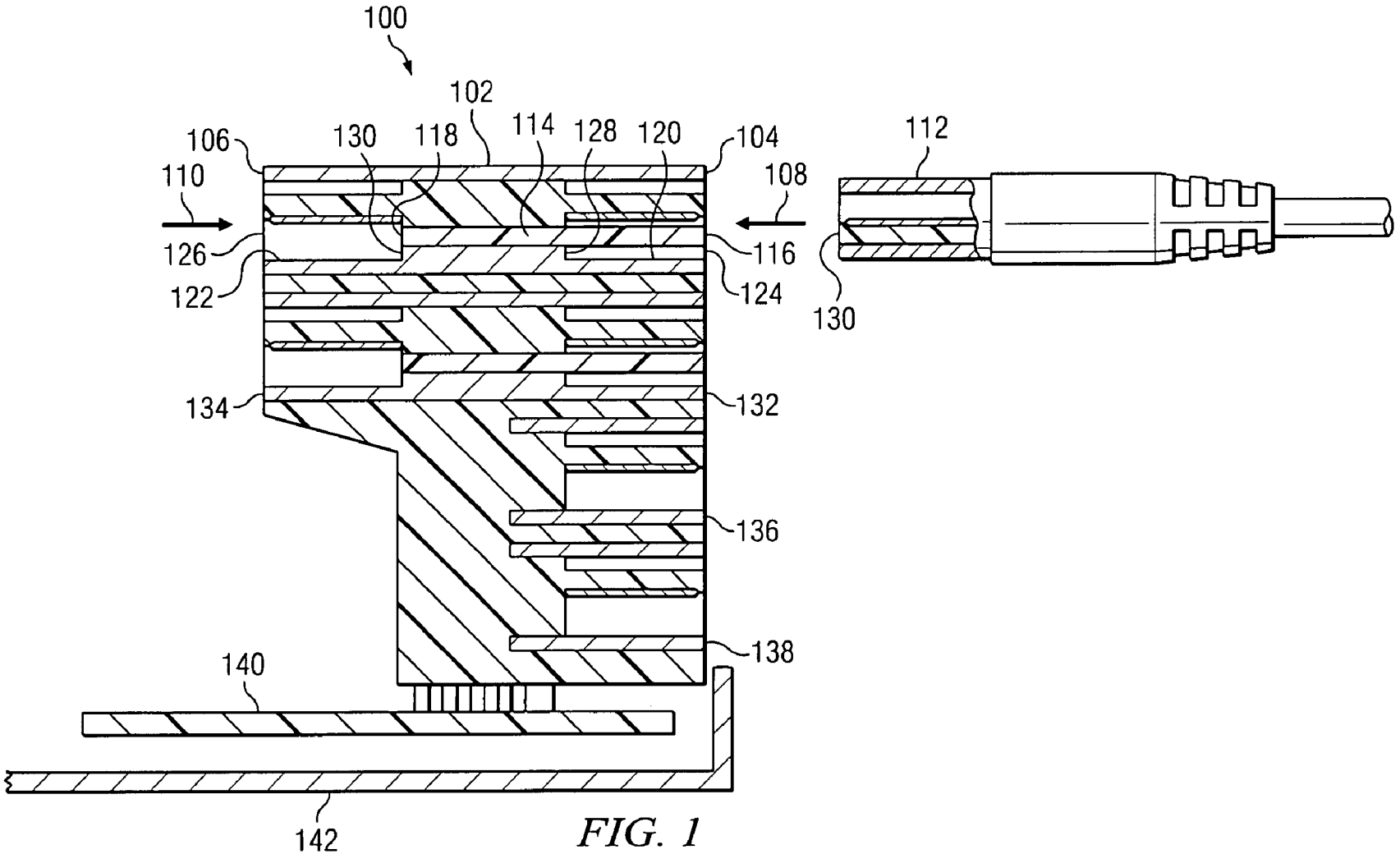
FIG. 1 is a sectional side view of a connector assembly according to a preferred embodiment of the invention.

Referring now to FIG. 1, connector assembly 100 includes a housing 102 that contains USB sockets 104, 106. Sockets 104, 106 are oriented at substantially 180 degrees from one another on opposite sides of housing 102 and define insertion paths 108, 110, respectively, for receiving a plug such as plug 112. Sockets 104, 106 include cavities 120, 122. Each cavity includes an open front end 124, 126 and a closed back end 128, 130 opposite the front end. Connector assembly 100 also includes a sliding keep-out member 114 having blocking surfaces 116, 118. Preferably, the longitudinal length of keep-out member 114 is approximately equal to the distance between the front end of socket 104 and the back end of cavity 122, as shown.

Figure 2A:
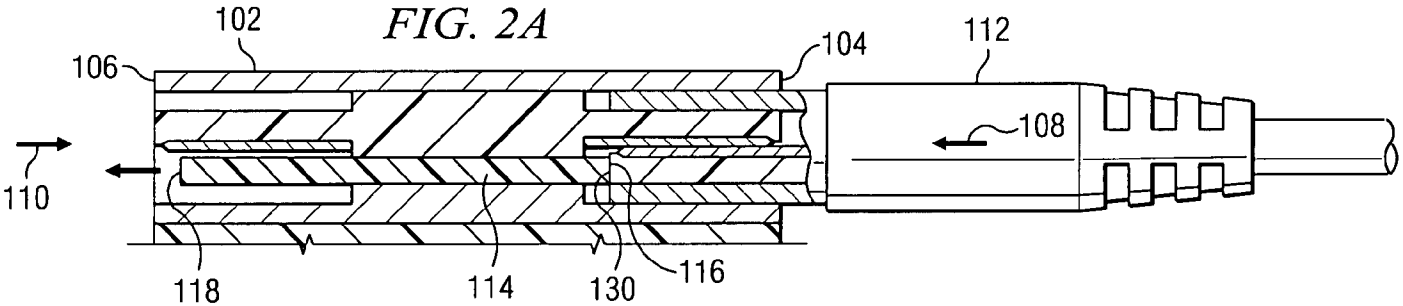
FIGS. 2A and 2B are sectional side views of a portion of the connector assembly of FIG. 1 showing a plug being inserted from the right.
Figure 2B:
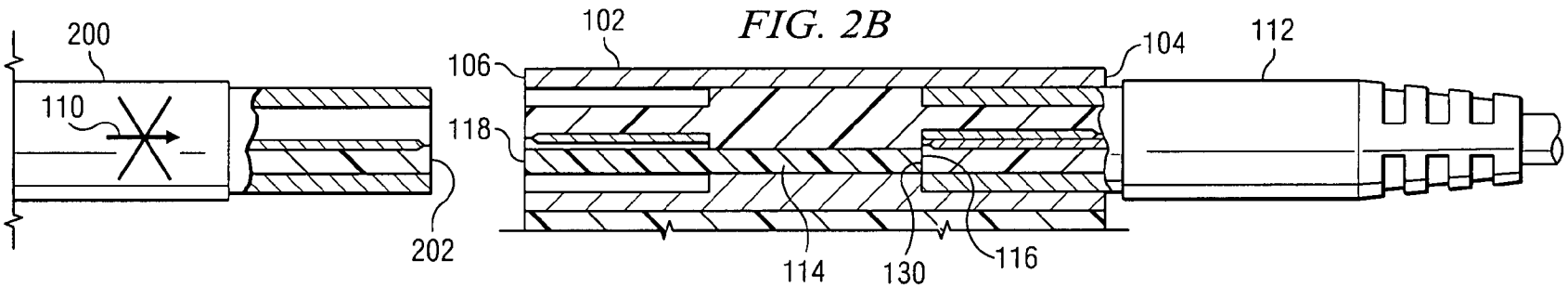

The operation of keep-out member 114 will now be described with reference to FIGS. 2A and 2B. Keep-out member 114 is capable of moving back and forth through housing 102 between first and second positions. In the first position (illustrated in FIGS. 1 and 3), surface 116 blocks at least a portion of insertion path 108 but surface 118 clears insertion path 110. In the second position (illustrated in FIG. 2B), surface 118 blocks at least a portion of insertion path 110 but surface 116 clears insertion path 108. Movement of keep-out member 114 within housing 102 is caused by an insertion force applied by a plug surface (such as plug surface 130) against one of blocking surfaces 116, 118. For example, as plug 112 is inserted into socket 104 from the right as shown in FIG. 2A, plug surface 130 engages blocking surface 116, causing keep-out member 114 to slide to the left. Once plug 112 is fully inserted in socket 104, keep-out member 114 will have moved from its first to its second position as shown in FIG. 2B. If an attempt is made to insert plug 200 into socket 106 while keep-out member 114 is in this position, plug surface 202 will engage blocking surface 118 and thus prevent the insertion. Alternatively, if enough force is applied to plug 200, plug 200 may eject plug 112 from socket 104.

Housing 102, sockets 104, 106 and keep-out member 114 may be constructed using any suitable material, such as molded plastic. Housing 102 may also contain other sockets such as sockets 132, 134 (formed identically with sockets 104, 106) or conventional sockets 136, 138. Some or all of the sockets may be disposed in a stacked relationship to conserve space.

Figure 3:
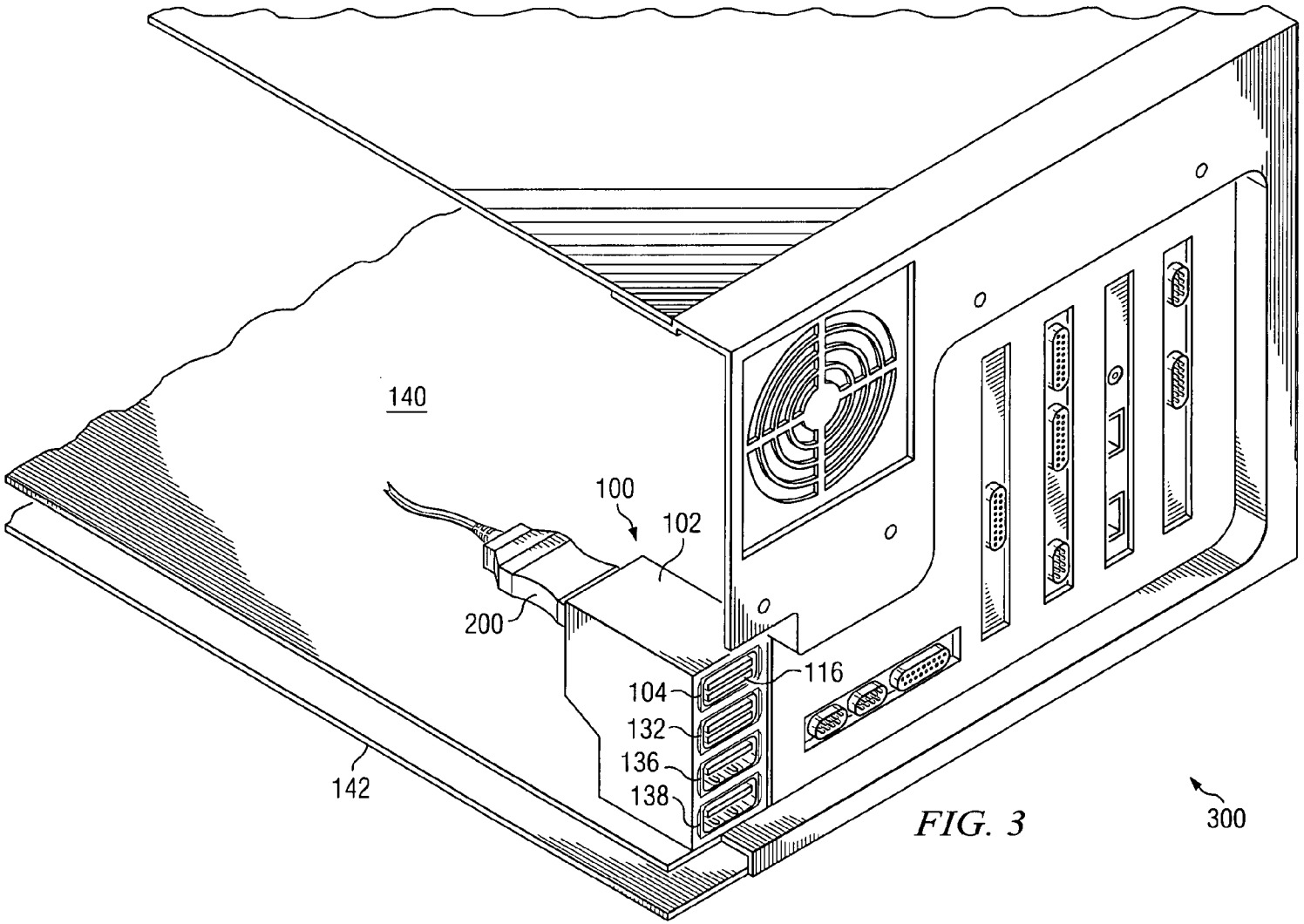
FIG. 3 is a cutaway view of an electronic device that includes a connector assembly according to a preferred embodiment of the invention.

The assembly may be mounted and electrically connected to a printed circuit board 140 contained inside the enclosure 142 of an electronic device such as a computer 300 (see FIG. 3). Preferably, assembly 100 should be oriented such that socket 104 is accessible from outside enclosure 142, while socket 106 is accessible from inside enclosure 142, as shown.

What is claimed is:

1. A connector assembly, comprising:

a housing;

first and second sockets oriented at substantially 180 degrees from one another on opposite sides of the housing and defining first and second insertion paths, respectively, for receiving a plug; and a sliding keep-out member having first and second blocking surfaces and capable of moving back and forth through the housing between first and second positions such that, in the first position, the first blocking surface blocks at least a portion of the first insertion path but the second blocking surface clears the second insertion path and, in the second position, the second blocking surface blocks at least a portion of the second insertion path but the first blocking surface clears the first insertion path.

2. The connector assembly of claim 1, wherein:

the first and second sockets include first and second cavities, respectively, each cavity having an open front end and a closed back end opposite the front; and wherein a length of the keep-out member is approximately equal to the distance between the back end of the first cavity and the front end of the second cavity.

3. The connector assembly of claim 1, wherein:

the first and second sockets are USB sockets.

4. The connector assembly of claim 1, wherein:

the housing also contains at least a third socket disposed in a stacked arrangement with either the first or the second sockets.

5. The connector assembly of claim 1, wherein:

the assembly is mounted in an electronic device having an enclosure such that the first socket is accessible from outside the enclosure and the second socket is accessible from inside the enclosure.

6. The connector assembly of claim 5, wherein:

the electronic device is a computer.

7. An electronic device, comprising:

an enclosure; and a connector assembly, the connector assembly comprising: a housing;

first and second sockets oriented at substantially 180 degrees from one another on opposite sides of the housing and defining first and second insertion paths, respectively, for receiving a plug; and a sliding keep-out member having first and second blocking surfaces and capable of moving back and forth through the housing between first and second positions such that, in the first position, the first blocking surface blocks at least a portion of the first insertion path but the second blocking surface clears the second insertion path and, in the second position, the second blocking surface blocks at least a portion of the second insertion path but the first blocking surface clears the first insertion path;

wherein the connector assembly is disposed within the electronic device such that the first socket is accessible from outside the enclosure and the second socket is accessible from inside the enclosure.

8. The electronic device of claim 7, wherein:

the first and second sockets include first and second cavities, respectively, each cavity having an open front end and a closed back end opposite the front; and wherein the length of the keep-out member is approximately equal to the distance between the back end of the first cavity and the front end of the second cavity.

9. The electronic device of claim 7, wherein:

the electronic device is a computer.

10. The electronic device of claim 7, wherein:

the first and second sockets are USB sockets.

11. The electronic device of claim 7, wherein:

the housing also contains at least a third socket disposed in a stacked arrangement with either the first or the second sockets.

* * * * *